US012595756B2

(12) United States Patent
Walters et al.

(10) Patent No.: US 12,595,756 B2
(45) Date of Patent: Apr. 7, 2026

(54) REVERSIBLE OIL PAN FOR AN INTERNAL COMBUSTION ENGINE

(71) Applicant: Caterpillar Inc., Peoria, IL (US)

(72) Inventors: Dean W. Walters, Rapid City, SD (US); Grant M. Klobuchar, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 18/567,113

(22) PCT Filed: May 16, 2022

(86) PCT No.: PCT/US2022/029383

§ 371 (c)(1),
(2) Date: Dec. 5, 2023

(87) PCT Pub. No.: WO2022/260830

PCT Pub. Date: Dec. 15, 2022

(65) Prior Publication Data

US 2024/0271552 A1 Aug. 15, 2024

(30) Foreign Application Priority Data

Jun. 10, 2021 (GB) ..... 2108321

(51) Int. Cl.
*F01M 11/00* (2006.01)
*F01M 11/04* (2006.01)

(52) U.S. Cl.
CPC ..... *F01M 11/0004* (2013.01); *F01M 11/0408* (2013.01); *F01M 2011/0054* (2013.01);
(Continued)

(58) Field of Classification Search
CPC ..... F01M 11/0004; F01M 2011/007; F01M 2011/0054; F01M 2011/0091
See application file for complete search history.

(56) References Cited

U.S. PATENT DOCUMENTS 4,479,463 A * 10/1984 Curley ..... F01M 11/0004 123/196 R
4,615,314 A 10/1986 Baugh
(Continued)

FOREIGN PATENT DOCUMENTS

DE 202005010604 U1 * 12/2006 ..... F01M 11/0004
DE 102012100988 A1 8/2013
(Continued)

OTHER PUBLICATIONS

Great Britain Search Report related to Application No. GB2108321.7; reported on Mar. 4, 2022.
(Continued)

*Primary Examiner* — Minh Truong
(74) *Attorney, Agent, or Firm* — Xsensus LLC

(57) ABSTRACT

An oil pan for an engine comprises a containment portion of unitary construction. The containment portion has a circumferential component defining a circumferential extent of the containment portion and comprising a pair of mutually opposing side walls. The containment portion also comprises a base wall extending inwardly from a first portion of the circumferential component and defining a lower extent of the containment portion. The oil pan also comprises an attachment portion comprising an attachment surface at a second portion of the circumferential component; a first plug portion on an interior of a first one of the pair of mutually opposing side walls at a first location; and a second plug portion on an interior of a second one of the pair of mutually opposing side walls at a second location. The first and second plug portions are configured to receive an oil syphon connector and the attachment portion has a rotational symmetry such that the attachment surface is connectable to an engine block in a first orientation and in a second orientation. The first and second plug portions are located such that an oil tube having a fixed location relative to the engine
(Continued)

block aligns adjacent the first plug portion on attachment of the attachment portion to the engine block in the first orientation and aligns adjacent the second plug portion on attachment of the attachment portion to the engine block in the second orientation.

20 Claims, 11 Drawing Sheets

(52) U.S. Cl.
CPC ..... *F01M 2011/007* (2013.01); *F01M 2011/0091* (2013.01); *F01M 2011/0416* (2013.01)

(56) References Cited

U.S. PATENT DOCUMENTS 5,988,134 A * 11/1999 Smietanski ..... F01M 11/0004 123/196 R
6,142,257 A 11/2000 Bruener et al.
6,705,270 B1 * 3/2004 Rau ..... F01M 11/0004 184/106
2010/0224450 A1 9/2010 Dods et al.
2015/0028038 A1 * 1/2015 Franz ..... F01M 11/0004 220/573
2016/0130995 A1 5/2016 England et al.
2021/0047950 A1 2/2021 Franz et al.

FOREIGN PATENT DOCUMENTS

DE 102014104688 A1 10/2015
EP 3623599 A1 3/2020

OTHER PUBLICATIONS

International Search Report related to Application No. PCT/EP2022/029383; reported on Aug. 2, 2022.

* cited by examiner

REVERSIBLE OIL PAN FOR AN INTERNAL COMBUSTION ENGINE

CROSS-REFERENCE TO RELATED APPLICATION

This application is a USC § 371 US National Stage filing International Application No. PCT/EP2022/029383 filed on May 16, 2022 which claims priority under the Paris Convention to Great Britain Patent Application 2108321.7 filed on Jun. 10, 2021.

TECHNICAL FIELD

The disclosure relates to the field of oil pans for internal combustion engines.

BACKGROUND

It is common to provide an oil pan for an internal combustion engine that is bespoke not only to the model of internal combustion engine but also potentially also to the model of machine or vehicle in which the internal combustion engine is intended to be used. This is to accommodate different packaging constraints on different machines and vehicles.

Oil pans are most commonly made of metal, which is generally cast as a unitary component. However, additional fabrication steps are often undertaken, such as machining and/or the addition of some elements by welding.

More recently, composite oil pans have been introduced. Composite oil pans are generally moulded as a single unitary component. Machining of composite oil pans is less common than for metal oil pans. Moreover, fabrication of multiple moulded composite oil pan components by plastic welding would generally be avoided due to limitations in the resultant weld strength relative to metal weld strength.

It is also common that an oil syphon that collects oil from the oil pan for supply to the internal combustion engine is connected to the engine block before the oil pan is fitted to the internal combustion engine and is not mechanically connected directly to the oil pan.

SUMMARY

Against this background there is provided an oil pan in accordance with claim 1.

In this way, a single specification of oil pan may be deployed on an internal combustion engine in either one or two orientations, so as to facilitate differing constraints of different machines that may comprise the engine. Consequently, when the oil pan is attached to an engine block of the engine, the oil tube of the engine, which has a fixed location relative to the engine block, will align with either the first plug portion or the second plug portion.

By enabling the same oil pan to be deployed in two orientations, a larger number of machines and vehicles having different packaging constraints can accommodate the oil pan, which reduces the need for different oil pans to be manufactured for the same specification of engine for use in different machines.

In a further aspect of the disclosure, there is provided an oil pan syphon connector configured for use with the oil pan. The oil pan syphon connector comprises a socket portion configured to correspond both to the first plug portion and to the second plug portion such that the socket portion can be deployed either with the first plug portion or with the second plug portion.

In this way, a single oil pan and a single oil pan syphon connector may be deployed with the engine in either orientation. Thus, neither a different oil pan nor a different oil pan syphon connector is required to use the oil pan with an engine in either orientation.

BRIEF DESCRIPTION OF THE DRAWINGS

An embodiment of the disclosure is set out below with reference to the following Figures, in which.

DETAILED DESCRIPTION

The disclosure relates to an oil pan for an engine comprising:

- a containment portion of unitary construction, the containment portion having:
- a circumferential component defining a circumferential extent of the containment portion and comprising a pair of mutually opposing side walls;
- a base wall extending inwardly from a first portion of the circumferential component and defining a lower extent of the containment portion; and an attachment portion, the attachment portion comprising:
- an attachment surface at a second portion of the circumferential component;
- a first plug portion on an interior of a first one of the pair of mutually opposing side walls at a first location;
- a second plug portion on an interior of a second one of the pair of mutually opposing side walls at a second location;
- wherein the first and second plug portions are configured to receive an oil syphon connector; and
- wherein the attachment portion has a rotational symmetry such that the attachment surface is connectable to an engine block in a first orientation and in a second orientation; and wherein the first and second plug portions are located such that an oil tube having a fixed location relative to the engine block aligns adjacent the first plug portion on attachment of the attachment portion to the engine block in the first orientation and aligns adjacent the second plug portion on attachment of the attachment portion to the engine block in the second orientation.

Figure 1:
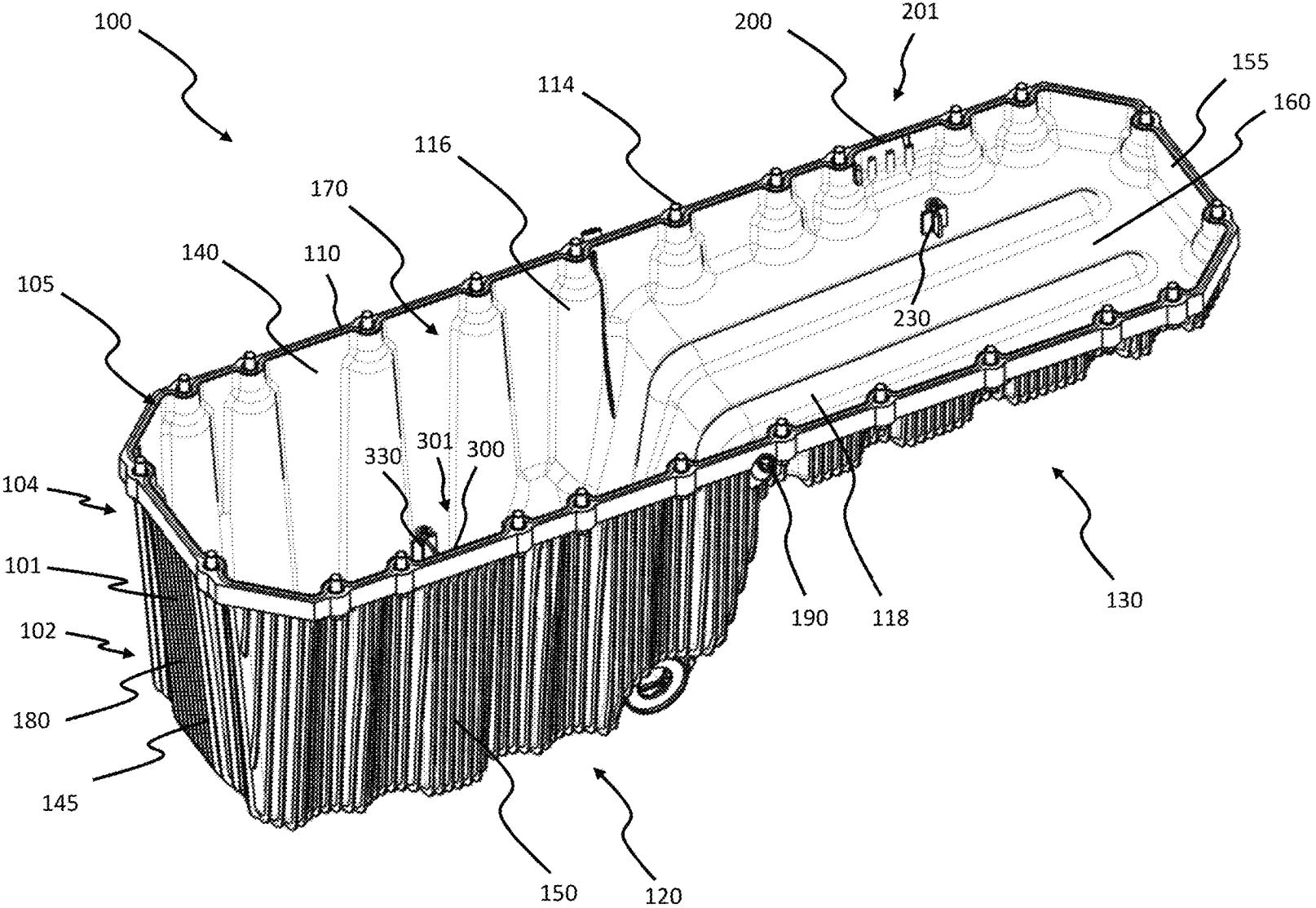
FIG. 1 shows an oil pan in accordance with the disclosure plus a plurality of connecting bolts for connecting the oil pan to an engine block.

FIG. 1 shows an oil pan 100 in accordance with one embodiment of the disclosure for use with an engine (not shown) plus a plurality of fixing bolts 114. The oil pan 100 comprises a containment portion 101 of unitary construction. The oil pan may be of a composite material and may be formed by moulding.

Figure 2:
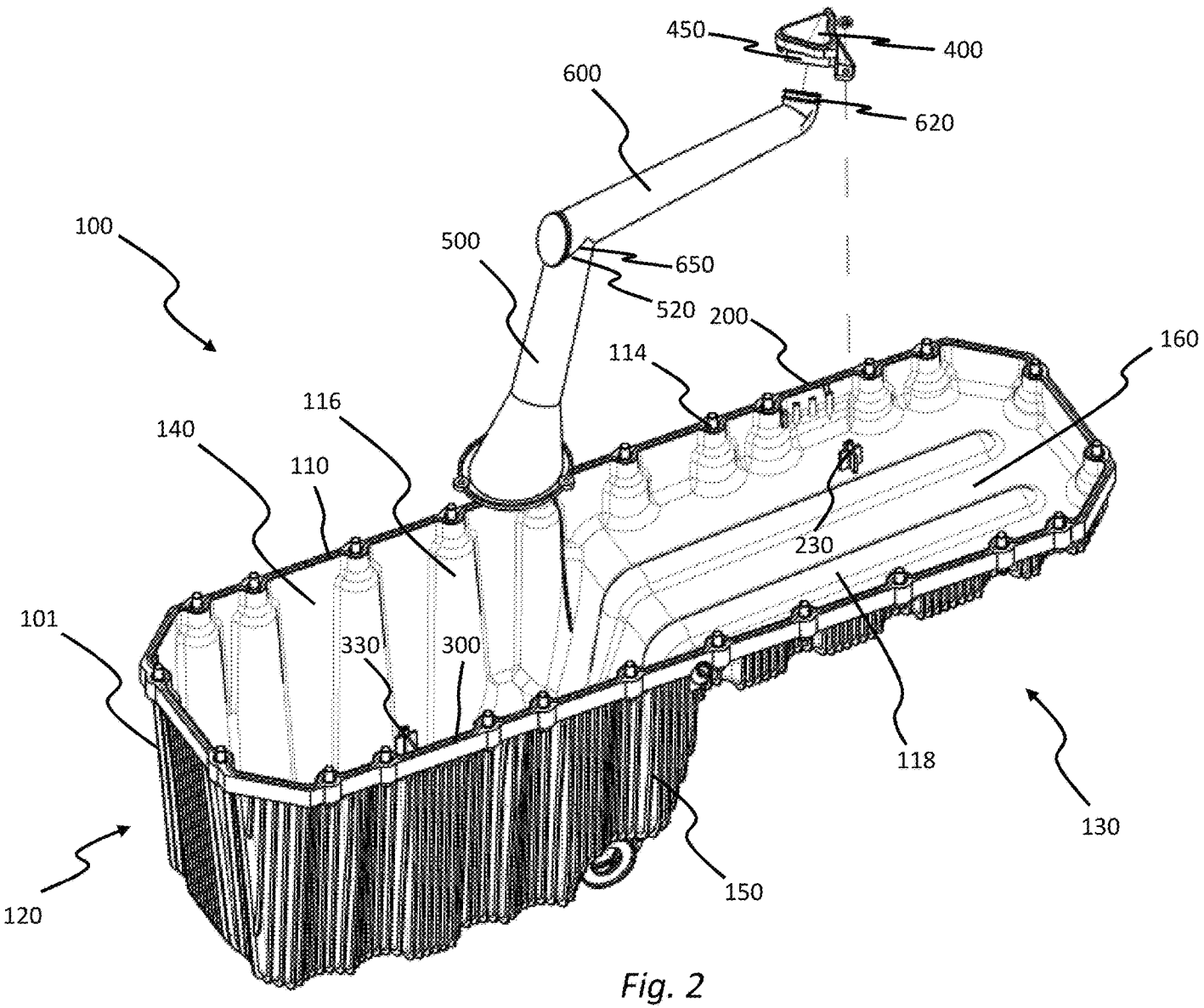
FIG. 2 shows an exploded view of a first oil pan assembly comprising the oil pan of FIG. 1, an oil pan syphon connector, and an oil pan syphon with a transfer tube.
Figure 3:
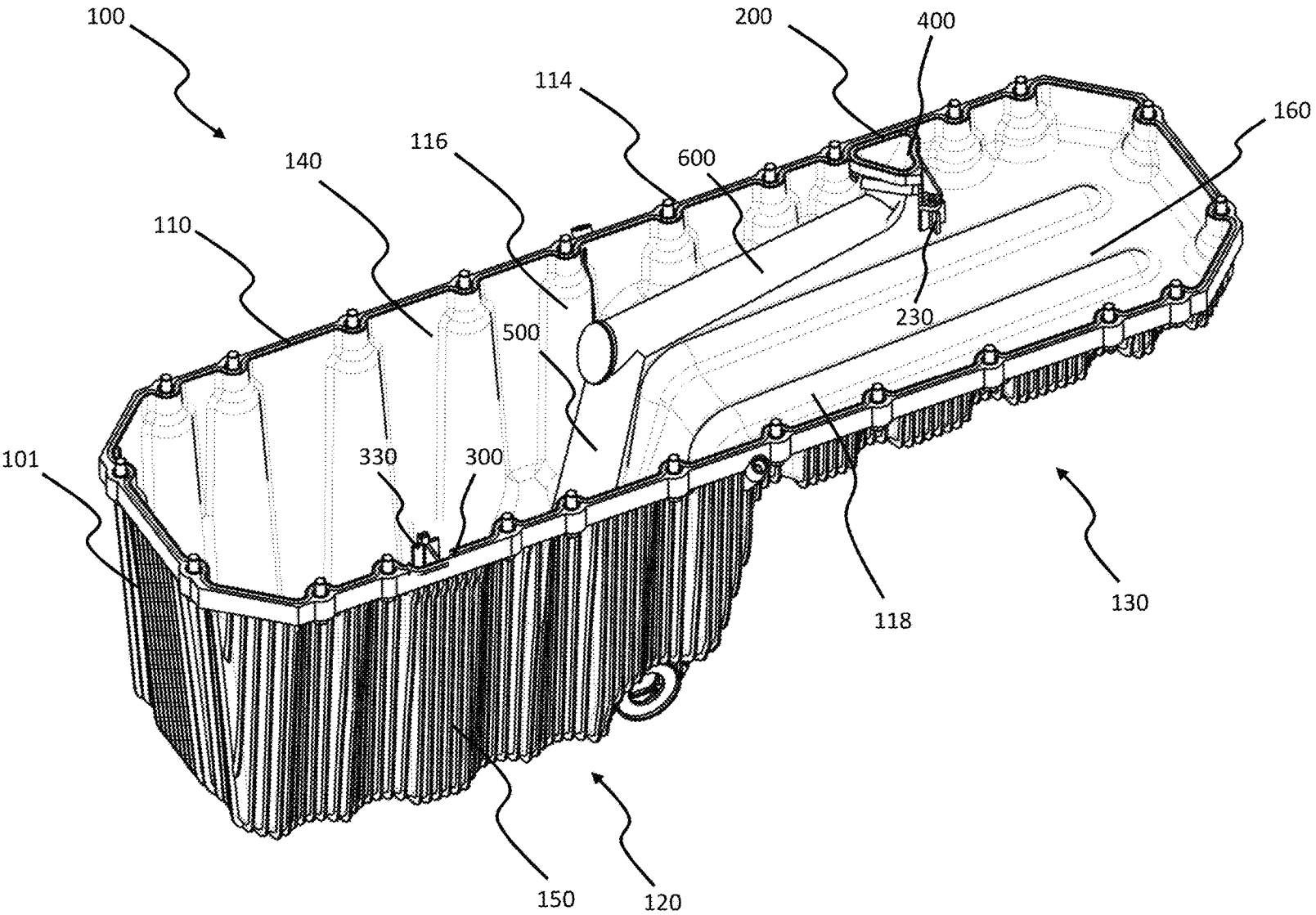
FIG. 3 shows the oil pan assembly of FIG. 2 in assembled form.

FIG. 2 shows an exploded view of the oil pan 100 together with an oil syphon connector 400, an oil syphon 500 and a transfer tube 600. FIG. 3 shows the same components as FIG. 2 in their assembled form.

Referring again to FIG. 1, the containment portion 101 comprises a circumferential component 180 defining a circumferential extent of the containment portion 101. The containment portion 101 has a first portion 102 and a second portion 104. The first portion 102 is a generally lower portion 102 while the second portion 104 is a generally upper portion 104, relative to the first portion 120. The circumferential component 180 comprises a pair of mutually opposing side walls 140, 150 and may further comprise a pair of mutually opposing end walls 145, 155. The pair of mutually opposing end walls 145, 155 may be perpendicular to the pair of mutually opposing side walls 140, 150.

The containment portion 101 further comprises a base wall 160 extending inwardly from the first portion 102 of the circumferential component 180 and defining a lower extent of the containment portion 101.

The oil pan 100 has an aperture 170 opposite the base wall 160 (the top opening in the orientation of FIG. 1). As such, the oil pan 100 defines a volume bounded by the containment portion 101 and the aperture 170, the volume facilitating containment of engine oil.

The containment portion 101 has a first end 120 and a second end 130. The first end 120 may be deeper than the second end 130. A first end wall 145 of the pair of mutually opposing end walls 145, 155 may be located at the first end 120 and a second end wall 155 of the second pair of mutually opposing end walls 145, 155 may be located at the second end 130. The second end wall 155 may be shorter than the first end wall 145.

The pair of mutually opposing side walls 140, 150 may each be shorter at the second end 130 than at the first end 120.

The base wall 160 may comprise a first portion at the first end 120, a second portion at the second end 130 and an intermediate portion between the first portion and the second portion. The intermediate portion may be sloped to accommodate a difference in height of the base wall between the first portion and the second portion.

In this way, the containment portion 101 may accommodate a greater volume at the first end 120 than at the second end 130.

The containment portion 101 may comprise an access port 190 configured to accommodate a dipstick to facilitate measurement of a level of oil in the containment portion 101.

The containment portion 101 further comprises an attachment portion 105. The attachment portion 105 comprises an attachment surface 110 at the second (upper) portion 104 of the circumferential component 180 proximate the aperture 170.

The circumferential component 180 may comprise a plurality of ribs 116 each of which extends substantially perpendicular to the attachment surface 110. The ribs 116 may contribute to structural rigidity of the oil pan 100. One or more of the plurality of ribs 116 may comprise a fixing aperture in the attachment portion 105, each fixing aperture configured to receive a fixing such as a bolt 114. In this way, the attachment portion 105 may be fastened to an underside of an engine block (not shown) using bolts 114 when the attachment portion 105 is located to meet with a corresponding attachment area on the underside of the engine block.

The attachment portion 105 has a rotational symmetry such that the attachment surface 110 is connectable to an engine block in a first orientation and in a second orientation. In this way, the oil pan 100 can be fastened to an engine block either with the first (deep) end 120 pointing in a first direction and the second (shallow) end 130 pointing in a second direction or it can be fastened to the same engine block with the first (deep) end 120 pointing in the second direction and the second (shallow) end 130 pointing in the first direction. This provides flexibility for use in different applications (such as different machines) having different packaging constraints.

The attachment portion 105 further comprises a first plug portion 200 on an interior of a first one of the pair of mutually opposing side walls 140 at a first location 201. The attachment portion 105 further comprises a second plug portion 300 on an interior of a second one of the pair of mutually opposing side walls 150 at a second location 301.

Given the rotational symmetry of the attachment portion 105, either the first plug portion 200 or the second plug portion 300 is located at the same location relative to the engine block depending upon the orientation in which the oil pan 100 is attached to the engine block.

Figure 6:
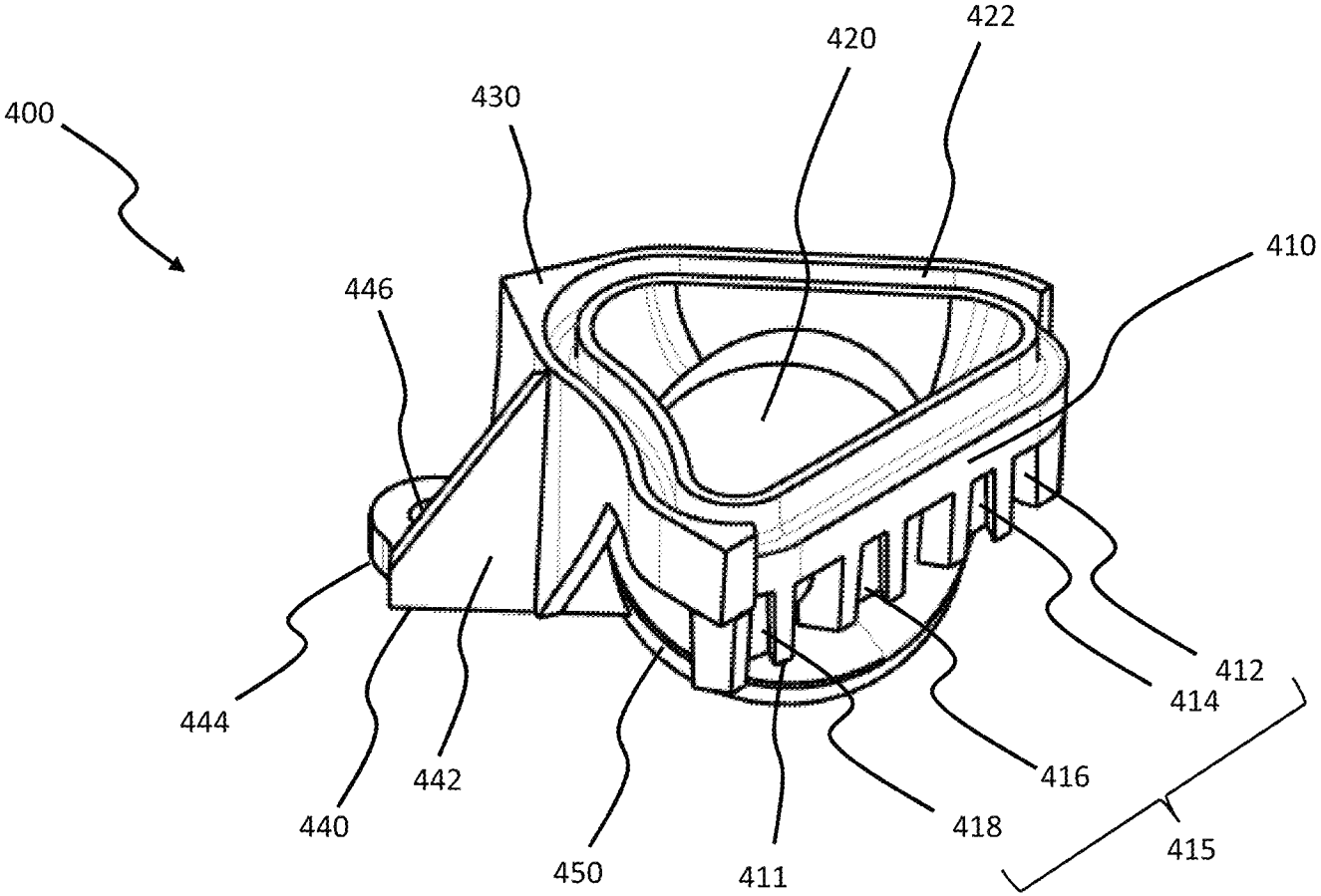
FIG. 6 shows a first view of the oil pan syphon connector in isolation.

Each of the first and second plug portions 200, 300 is configured to receive an oil syphon connector 400, such as the oil syphon connector 400 shown in FIG. 6.

In this way, an oil tube having a fixed location relative to the engine block aligns adjacent the first plug portion 200 on attachment of the attachment portion 105 to the engine block in the first orientation and aligns adjacent the second plug portion 300 on attachment of the attachment portion 105 to the engine block in the second orientation.

Figure 8:
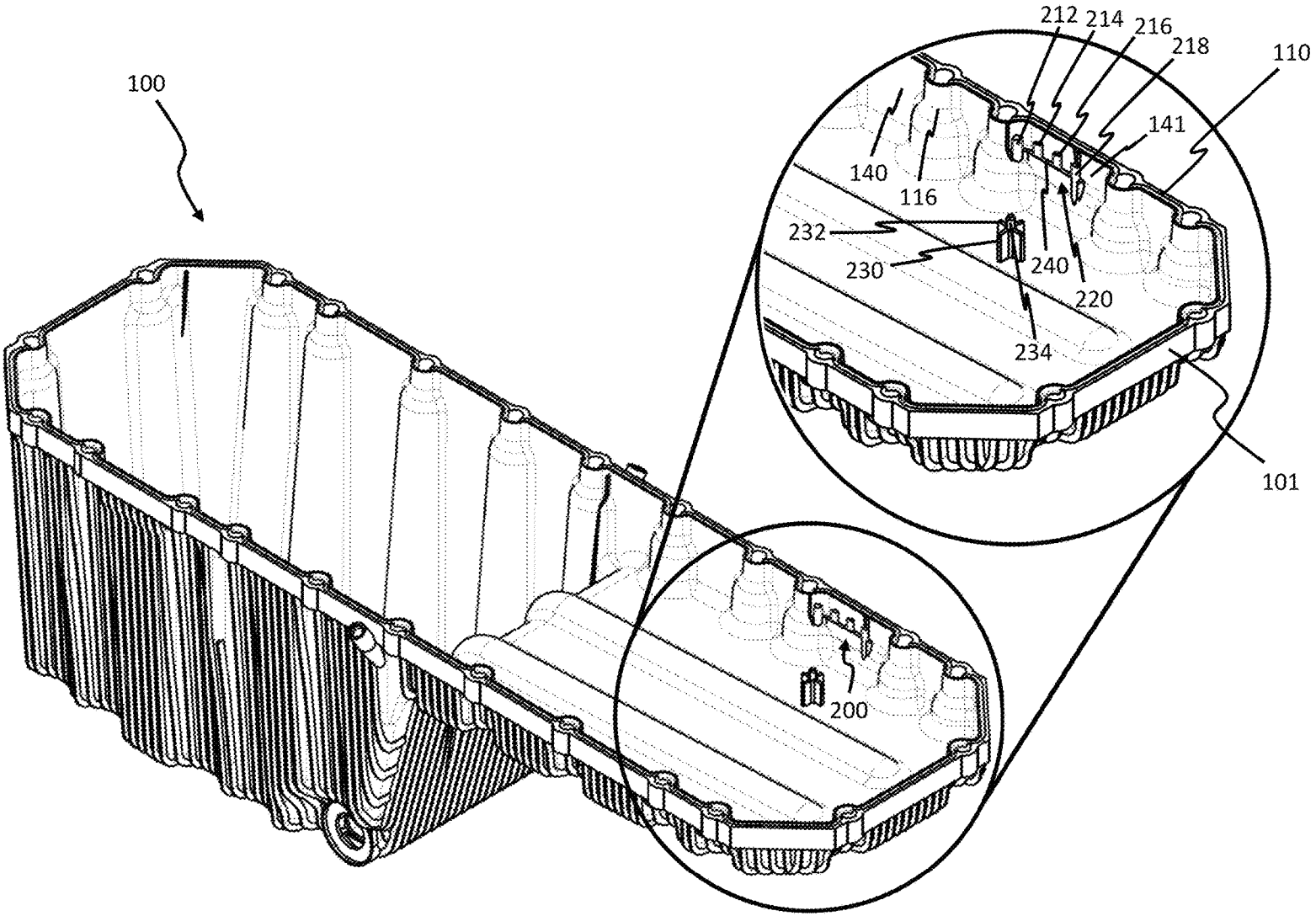
FIG. 8 shows the oil pan of FIG. 1 (without the connecting bolts) from a further perspective and with one of the attachment portions enlarged.
Figure 9:
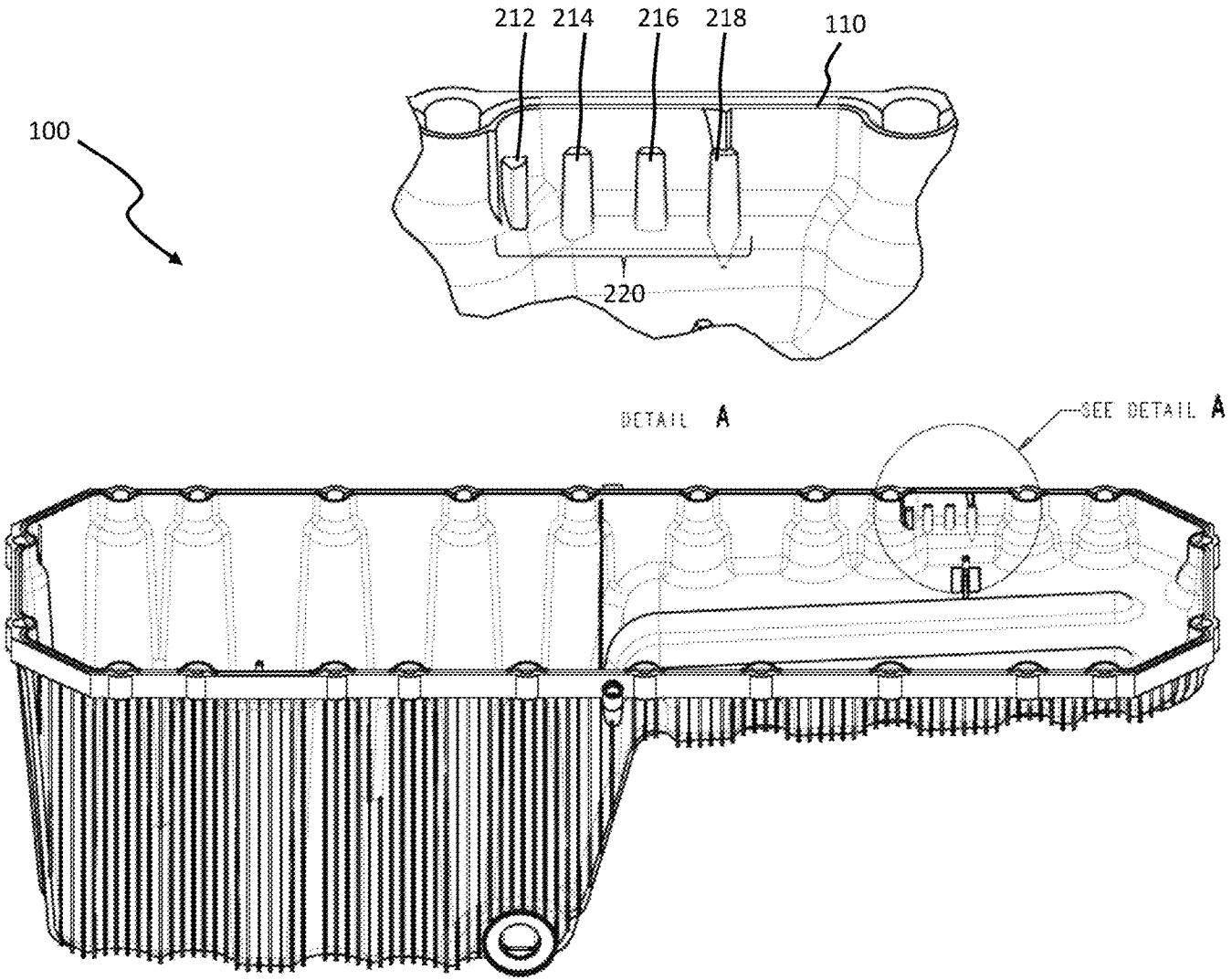
FIG. 9 shows the oil pan of FIG. 1 (again without the connecting bolts) from a still further perspective and with one of the attachment portions enlarged.

With reference to FIG. 8 and FIG. 9, the first plug portion 200 comprises a plurality of fingers 220. Each finger of the plurality of fingers 220 may protrude from an interior surface of the sidewall 140. Each finger of the plurality of fingers 220 may have an elongate direction that runs substantially perpendicular to the attachment surface 110, a length that runs substantially parallel to the attachment surface 110, and a width that runs substantially inwardly from the interior surface of the sidewall 140.

All fingers of the plurality of fingers 220 are substantially mutually parallel.

At least one of the fingers of the plurality of fingers 220 may taper in one or both of its width and its length so as to be narrower near the attachment surface 110 and wider away from the attachment surface. Where a finger tapers in at least one of its width and its length, the finger may be referred to as a wedge portion.

The plurality of fingers 220 may comprise a first finger 212, a second finger 214, a third finger 216 and a fourth finger 218. The first finger 212 may be located on one of the ribs 116. The second finger 214, the third finger 216 and the fourth finger 218 may each be located on a portion of the interior surface 141 of the sidewall 140 that is planar and between ribs 116. An inmost face of the second finger 214 and an inmost face of the third finger 216 may be substantially parallel to an axis of the sidewall 140. An inmost face of the first finger 212 may be at an angle to the axis of the sidewall 140 and an inmost face of the fourth finger 218 may be at an angle to the axis of the sidewall 140 such that there is an extent to which the inmost face of the first finger 212 and the inmost face of the fourth finger 218 face each other.

The first plug portion 200 may further comprise a pillar 230 configured to cooperate with a leg of the oil syphon connector. The pillar 230 may project upwardly from the base wall 160. The pillar 230 may comprise a surface 232 and an alignment pin 234 projecting upwardly from the surface 232. The first plug portion 200 may further comprise a lip 240 extending from the interior surface of the sidewall 140 and having an upper surface that is perpendicular to the interior surface of the sidewall 140.

One or both of the lip 240 and the surface 232 of the pillar 230 may act as an end stop to prevent further downward movement of an oil syphon connector 400.

Figure 4:
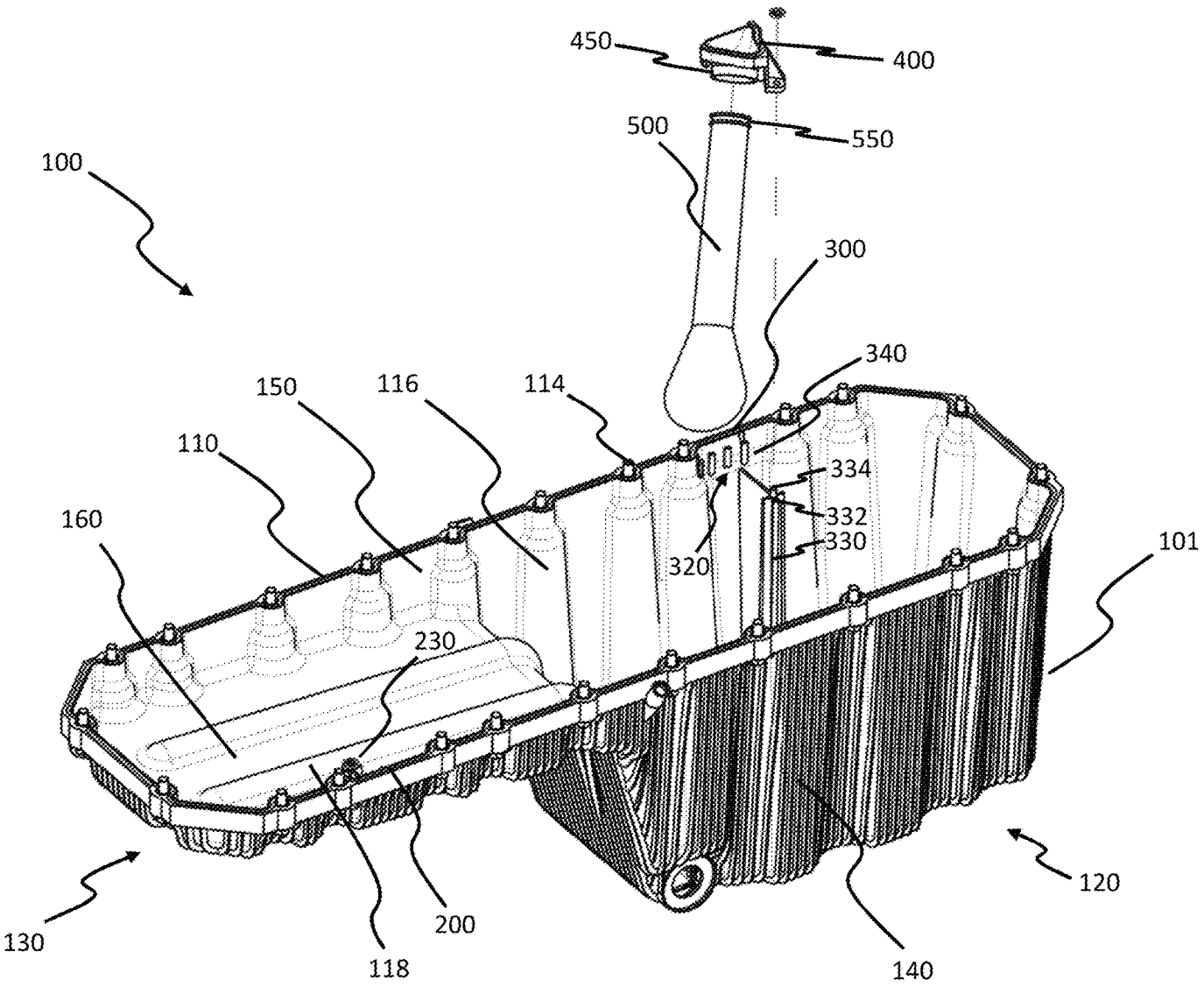
FIG. 4 shows an exploded view of a second oil pan assembly comprising the oil pan of FIG. 1, an oil pan syphon connector, and an oil pan syphon.
Figure 5:
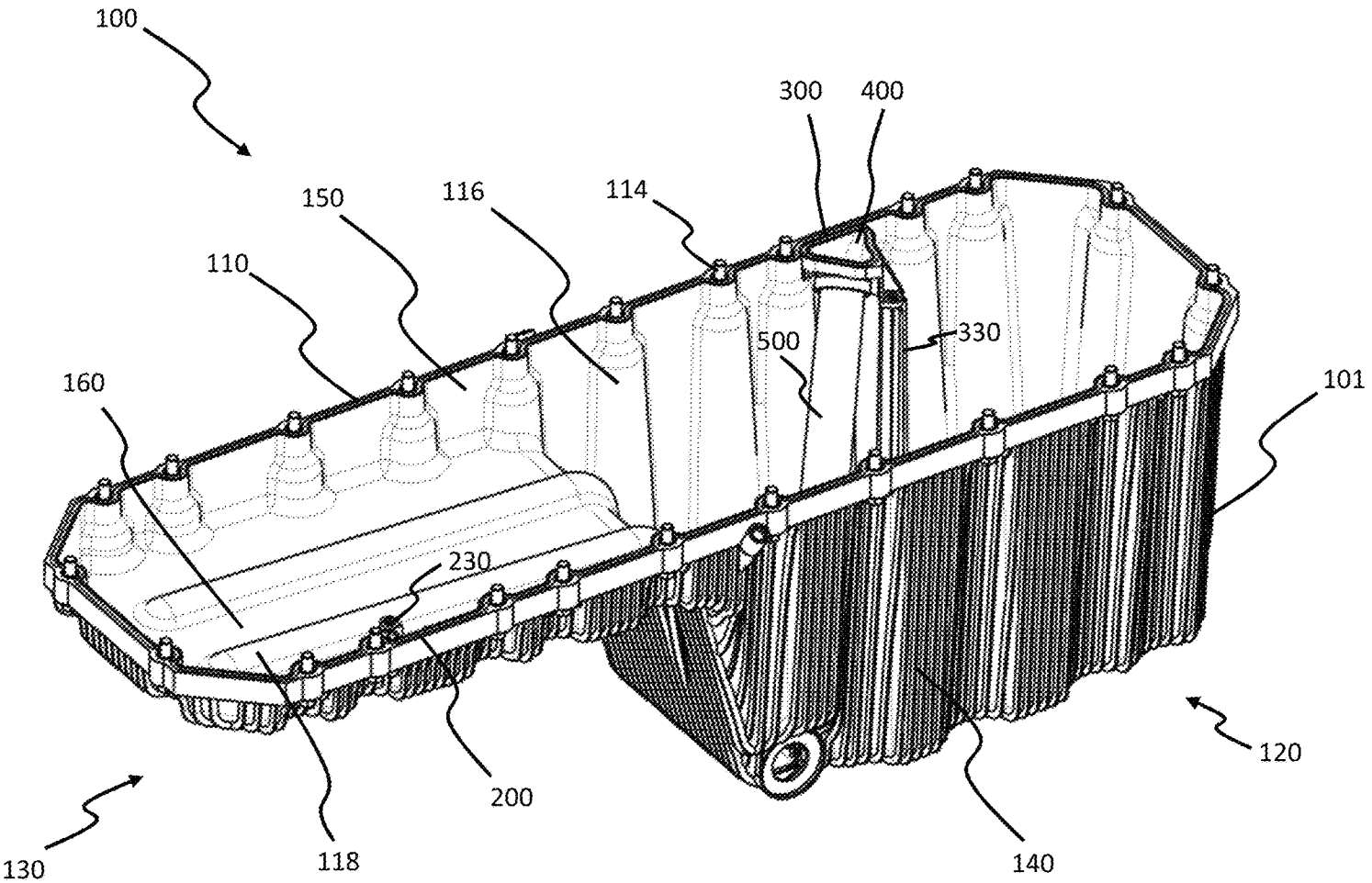
FIG. 5 shows the oil pan assembly of FIG. 4.

FIG. 4 shows an exploded view of the oil pan 100 in a different orientation from FIG. 2 together with an oil syphon connector 400 and an oil syphon 500 (but with no transfer tube 600). FIG. 5 shows the same components as FIG. 4 in their assembled form.

Referring to FIG. 4, the second plug portion 300 comprises a plurality of fingers 320. Each finger of the plurality of fingers 320 may protrude from an interior surface of the sidewall 140. Each finger of the plurality of fingers 320 may have an elongate direction that runs substantially perpendicular to the attachment surface 110, a length that runs substantially parallel to the attachment surface 110, and a width that runs substantially inwardly from the interior surface of the sidewall 150.

All fingers of the plurality of fingers 320 are substantially mutually parallel.

At least one of the fingers of the plurality of fingers 320 may taper in one or both of its width and its length so as to be narrower near the attachment surface 110 and wider away from the attachment surface 110. Where a finger tapers in at least one of its width and its length, the finger may be referred to as a wedge portion.

The plurality of fingers 320 may comprise a first finger (corresponding to first finger 212 but not individually labelled in the figures), a second finger (corresponding to second finger 214), a third finger (corresponding to third finger 216) and a fourth finger (corresponding to fourth finger 218). The first finger may be located on one of the ribs 116. The second finger, the third finger and the fourth finger may each be located on a portion of the interior surface of the sidewall 150 that is planar and between ribs 116. An inmost face of the second finger and an inmost face of the third finger may be substantially parallel to an axis of the sidewall 150. An inmost face of the first finger may be at an angle to the axis of the sidewall 150 and an inmost face of the fourth finger may be at an angle to the axis of the sidewall 150 such that there is an extent to which the inmost face of the first finger and the inmost face of the fourth finger face each other.

It should be noted that the plurality of fingers 220 at the first plug portion 200 might not be exactly identical to the plurality of fingers 320 at the second plug portion 300. However, it is necessary that the plurality of fingers 220 at the first plug portion 200 and the plurality of fingers 320 at the second plug portion 300 are compatible with the oil syphon connector 400, meaning there is at least a high degree of similarity between the plurality of fingers 220 at the first plug portion 200 and the plurality of fingers 320 at the second plug portion 300.

The second plug portion 300 may further comprise a pillar 330 configured to cooperate with a leg of the oil syphon connector. The pillar 330 may project upwardly from the base wall 160. The pillar 330 of the second plug portion 300 may be of a different length to the pillar 230 of the first plug portion 200 in view of the different depths of the oil pan 100 between the first end 120 and the second end 130. The pillar 330 may comprise a surface 332 and an alignment pin 334 projecting upwardly from the surface 332. The first plug portion 300 may further comprise a lip 340 extending from the interior surface of the sidewall 150 and having an upper surface that is perpendicular to the interior surface of the sidewall 150.

One or both of the lip 340 and the surface 332 of the pillar 330 may act as an end stop to prevent further downward movement of an oil syphon connector 400.

Figure 7:
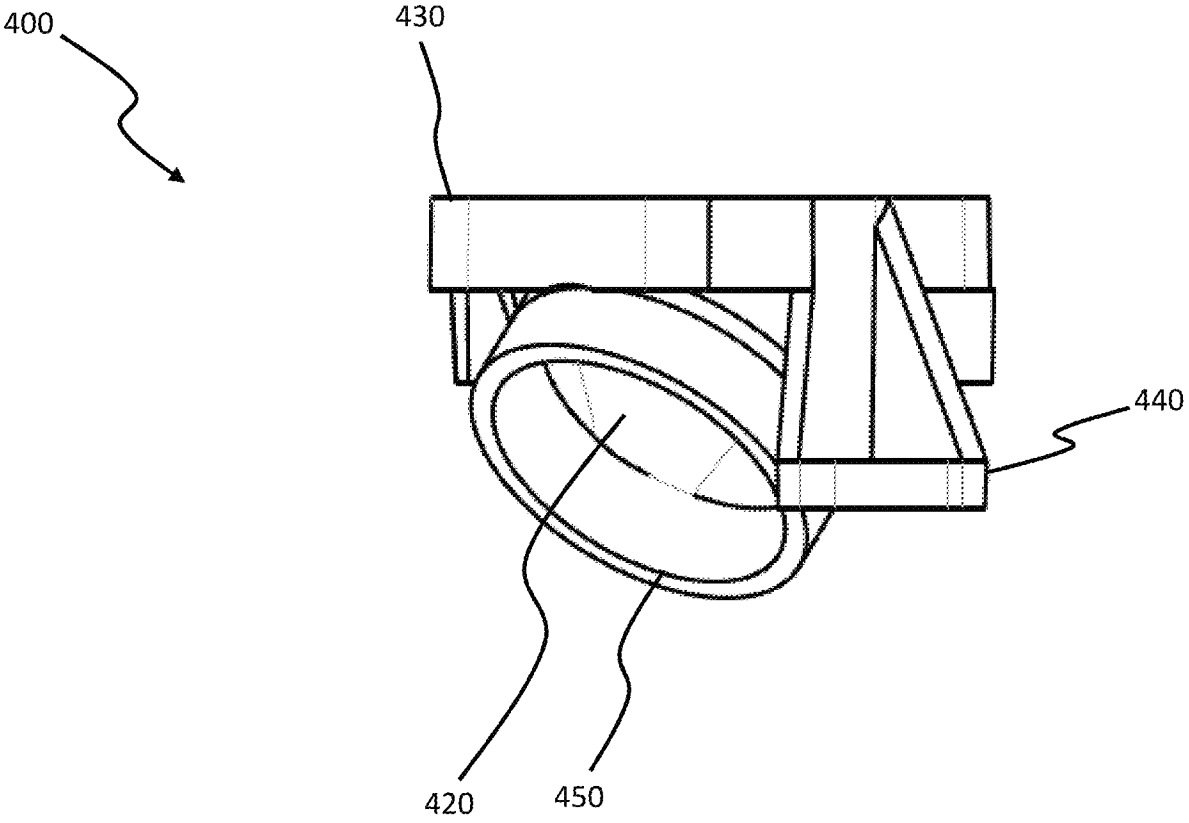
FIG. 7 shows a second view of the oil pan syphon connector in isolation.

An oil syphon connector 400 in accordance with the present disclosure is described with reference to FIG. 6 and FIG. 7.

The oil syphon connector 400 comprises a top face 430 that sits in a top plane of the oil syphon connector 400, a mating portion 410 on a first side of the oil syphon connector 400 perpendicular to the top face 430, an oil channel 420 that extends through the oil syphon connector 400 from the top face 430 to a connector outlet 450, and a leg 440 that extends from a second side of the oil syphon connector 400.

The mating portion 410 comprises a socket portion 415 comprising a plurality of apertures 415. The plurality of apertures 415 may comprise a first aperture 412, a second aperture 414, a third aperture 416 and a fourth aperture 418. The first aperture 412 is configured to correspond to and receive the first finger 212 of the first plug portion 200 and the first finger of the second plug portion 300 (not simultaneously). The second aperture 414 is configured to correspond to and receive the second finger 214 of the first plug portion 200 and the second finger of the second plug portion 300 (not simultaneously). The third aperture 416 is configured to correspond to and receive the third finger 216 of the first plug portion 200 and the third finger of the second plug portion 300 (not simultaneously). The fourth aperture 418 is configured to correspond to and receive the fourth finger 218 of the first plug portion 200 and the fourth finger of the second plug portion 300 (not simultaneously).

Where at least one of the fingers of the pluralities of fingers 220, 320 of the first and second plug portions 200, 300 has a taper as described above, the corresponding aperture of the plurality of apertures 415 may have a corresponding taper.

The mating portion 410 may further comprise a lower stop surface 411 distributed in between the plurality of apertures 415. The lower stop surface 411 may sit in a plane that is parallel to the top face 430.

The top face 430 may comprise components of a pip seal channel 422 configured to receive a pip seal (not shown). The pip seal channel 422 may be fully defined in the top face 430. Alternatively, and as in the illustrated embodiments, the pip seal channel 422 may be at least partly defined by the plug portion 200, 300 once the oil syphon connector 400 is in situ in the oil pan.

Figure 10:
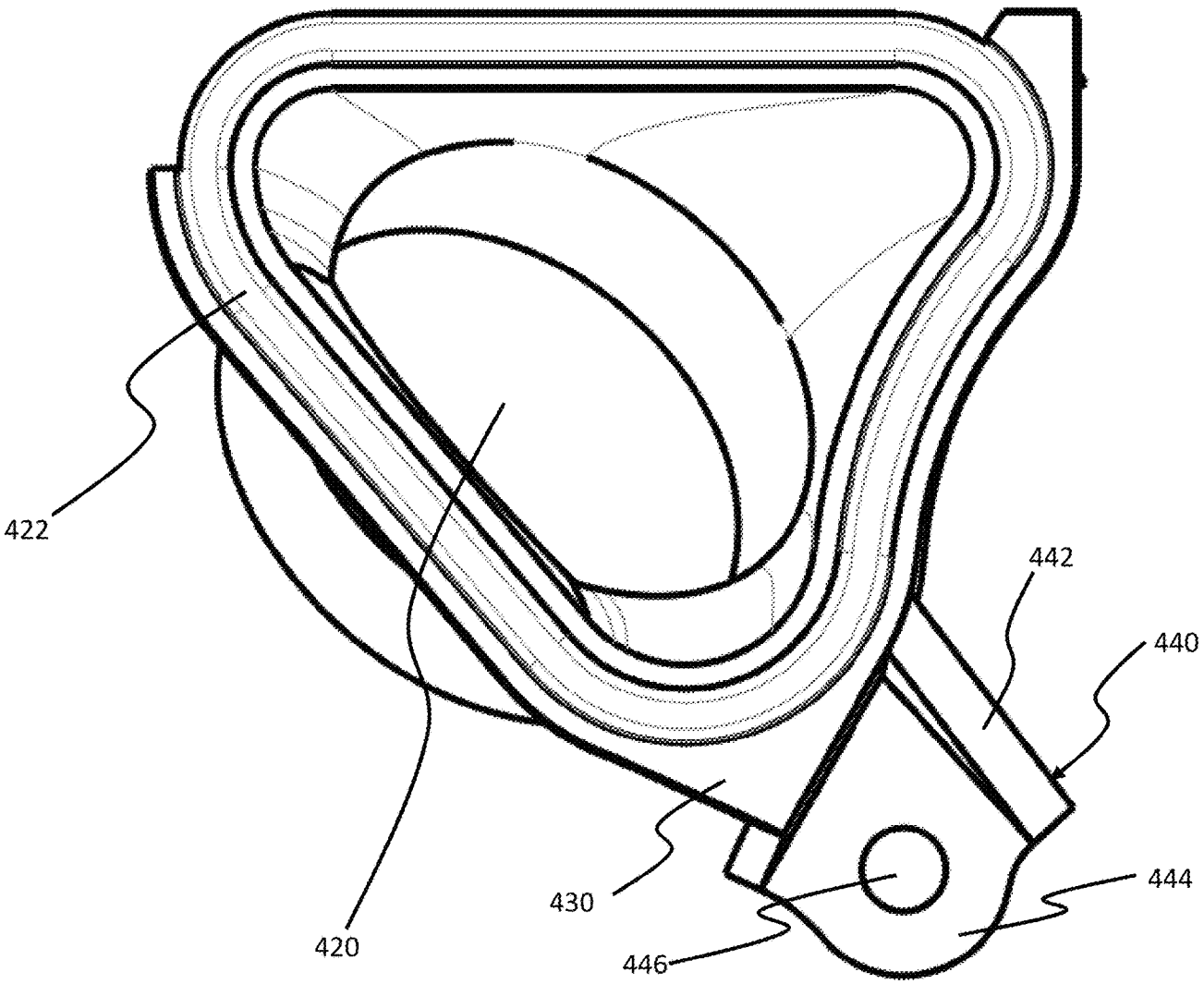
FIG. 10 shows a top view of the oil pan syphon connector of FIG. 6 and FIG. 7.
Figure 11:
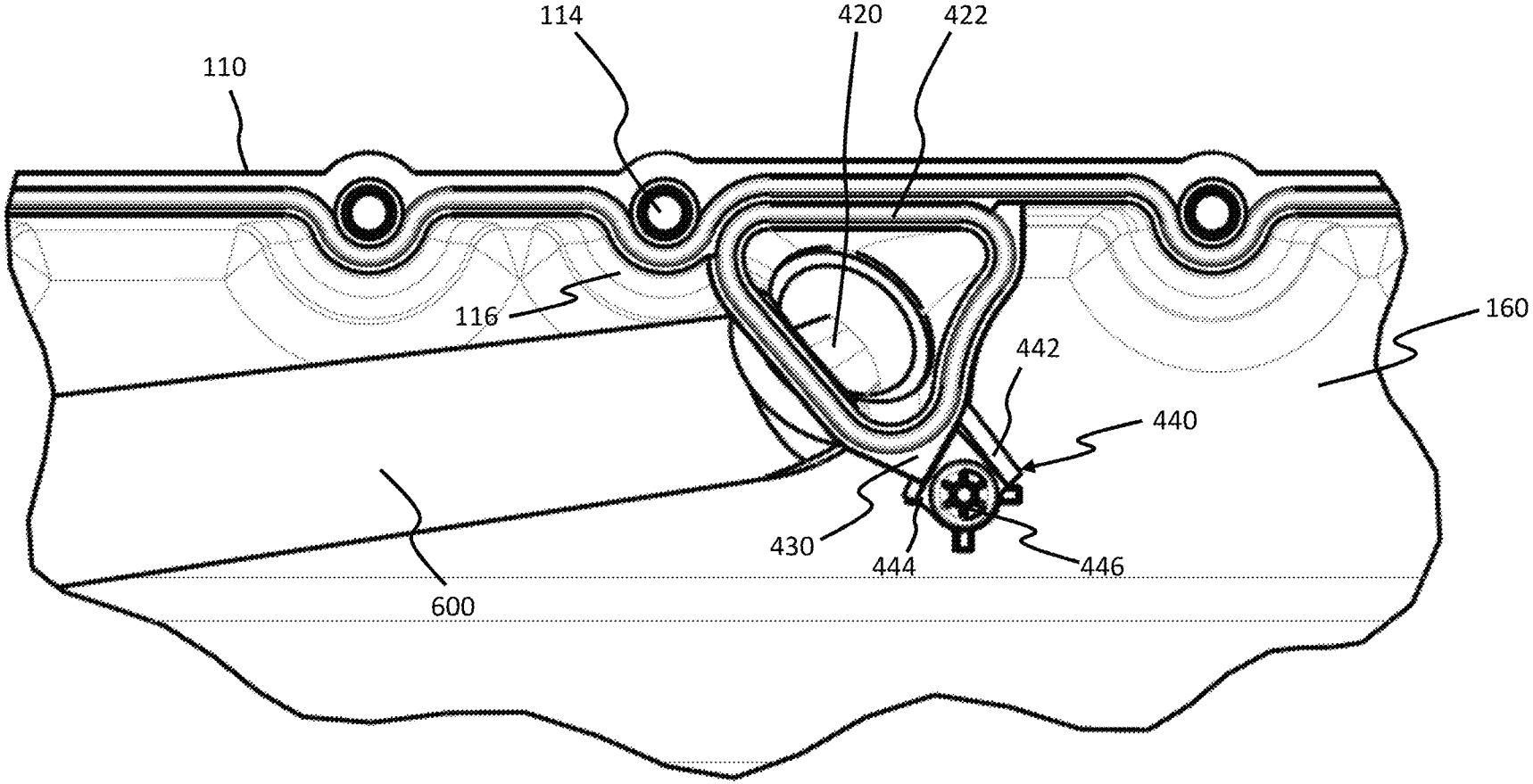
FIG. 11 shows a top view of the oil pan syphon connector of FIG. 10 in context with the related parts of the oil pan and with the transfer tube.

FIG. 10 shows the components of the pip seal channel 422 that are provided by the oil syphon connector 400. FIG. 11 shows the oil syphon connector 400 in situ with the oil pan 100 showing how the pip seal channel 422 is provided in part by the oil syphon connector 400 and in part by the plug portion 200, 300.

The leg 440 may comprise a buttress 442 and a foot 444 having a planar lower face. The foot 444 may comprise an aperture 446.

When in situ with an oil pan 100 in a first configuration using the first plug portion 200 (as shown in a first orientation in FIG. 3) some or all of the following may take place:

- the mating portion 410 cooperates with the plurality of fingers 220 of the first plug portion 200;
- the lower stop surface 411 rests on the lip 240;
- the top face 430 rests in the same plane as the attachment surface 110, the pip seal channel 422 being thereby completed;
- the planar lower face of the foot 444 rests on the surface 222 of the pillar 230; and
- the alignment pin 234 projects through the aperture 446 in the foot 444.

In this way, the oil syphon connector 400 may be held in position at the first plug portion 200.

When in situ with an oil pan 100 in a second configuration using the second plug portion 300 (as shown in a second orientation in FIG. 5) some or all of the following may take place:

- the mating portion 410 cooperates with the plurality of fingers 320 of the second plug portion 300;
- the lower stop surface 411 rests on the lip 340;
- the top face 430 rests in the same plane as the attachment surface 110, the pip seal channel 422 being thereby completed;
- the planar lower face of the foot 444 rests on the surface 332 of the pillar 330; and
- the alignment pin 334 projects through the aperture 446 in the foot 444.

In this way, the oil syphon connector 400 may be held in position at the second plug portion 300.

Where at least one of the fingers of the pluralities of fingers 220, 320 of the first and second plug portions 200, 300 has a taper and the corresponding aperture of the plurality of apertures 415 has a corresponding taper, this may facilitate an improved interference fit and elimination of movement of the oil syphon connector 400 relative to the oil pan 100 when the oil syphon connector 400 is in situ in the oil pan 100.

Referring to FIG. 2, the oil syphon connector 400 may be deployed at the first plug portion 200 with an oil syphon 500 and a transfer tube 600.

Referring to FIG. 4, the oil syphon connector 400 may be deployed at the second plug portion 300 with the oil syphon 500 (but without a transfer tube 600).

The connector outlet 450 of the oil syphon connector 400 may be connectable either to an inlet 620 of the transfer tube 600 or to an inlet 520 of the oil syphon 500.

An outlet 650 of the transfer tube 600 may be connectable to the inlet 520 of the oil syphon 500.

In this way, exactly the same oil syphon connector 400, and exactly the same oil syphon 500 may be deployed regardless of whether the first plug portion 200 or the second plug portion 300 is in use. The transfer tube 600 is only required in the event that the first plug portion 200 is in use and is not required if the second plug portion 300 is in use.

INDUSTRIAL APPLICABILITY

The oil pan 100 and oil syphon connector 400 of the present disclosure gives rise to the possibility of using an identical oil pan 100 (and oil syphon connector 400) with an engine in two different configurations, depending on the orientation of the oil pan 100 relative to the engine.

This means that the same components may be deployed in a different configuration effectively to produce a different assembly of those products in order to facilitate different packaging constraints on different machines that use the same engine and the same oil pan 100.

Manufacturing only a single design of oil pan 100, a single design of oil syphon connector 400, a single design of oil syphon 500 and a single design of transfer tube 600 (only required for one of the two orientations) in order to produce what are effectively two different oil pan assemblies suitable for different applications brings manufacturing efficiency, minimum number of production lines, reduced manufacturer part count, reduced part count across multiple engine platforms and reduced development costs.

Furthermore, by providing the oil syphon connector 400 which is fixed relative to the oil pan 100, it is possible to bring the already fully assembly oil pan assembly to the engine block and fix the entire syphon functionality onto the engine with the oil pan assembly rather than the previously common approach of having to assemble the syphon to the engine block before the assembling the oil pan to the engine block. This removes a step from an engine assembly process as the oil pan assembly can be pre-assembled in the absence of the engine.

By producing the oil pan as a single unitary component that may be manufactured by moulding, the number of process steps is reduced compared to a conventional cast metal oil pan that may require some subsequent fabrication steps, such as welding.

The invention claimed is:

1. An oil pan for an engine comprising:

a containment portion of unitary construction, the containment portion including:

a circumferential component defining a circumferential extent of the containment portion and comprising a pair of mutually opposing side walls, and a base wall extending inwardly from a first portion of the circumferential component and defining a lower extent of the containment portion; and an attachment portion, the attachment portion including:

an attachment surface at a second portion of the circumferential component, a first plug portion on an interior of a first one of the pair of mutually opposing side walls at a first location, and a second plug portion on an interior of a second one of the pair of mutually opposing side walls at a second location, wherein the first and second plug portions each include a first finger that extends radially inwardly from the circumferential component and extends in a direction substantially perpendicular to the attachment surface, the first finger having a wedge component that tapers outwardly as it extends radially inwardly and/or tapers outwardly as it extends towards the base, wherein the first and second plug portions are configured to receive an oil syphon connector, wherein the attachment portion has a rotational symmetry such that the attachment surface is connectable to an engine block in a first orientation and in a second orientation, and wherein the first and second plug portions are located such that an oil tube having a fixed location relative to the engine block aligns adjacent the first plug portion on attachment of the attachment portion to the engine block in the first orientation and aligns adjacent the second plug portion on attachment of the attachment portion to the engine block in the second orientation.

2. An oil pan for an engine comprising:

a containment portion of unitary construction, the containment portion being elongate and including:

a circumferential component defining a circumferential extent of the containment portion and having a pair of mutually opposing long side walls and a pair of mutually opposing short side walls, and a base wall extending inwardly from a first portion of the circumferential component and defining a lower extent of the containment portion and an upper extent of the containment portion, and an attachment portion, the attachment portion including:

an attachment surface at a second portion of the circumferential component, a first plug portion on an interior of a first one of the pair of mutually opposing long side walls at a first location, a second plug portion on an interior of a second one of the pair of mutually opposing long side walls at a second location, and a pillar adjacent the first plug portion that projects upward from the base wall in the upper extent of the containment portion, wherein the attachment portion has a rotational symmetry such that the attachment surface of the attachment portion is connectable to an engine block in a first orientation and in a second orientation of the oil pan, wherein the first and second plug portions are configured to separately receive an oil syphon connector, the oil syphon connector being only receivable on the first plug portion in the first orientation, and the oil syphon connector being only receivable on the second plug portion in the second orientation, and wherein the first plug portion has a first finger that extends inward from the circumferential component.

3. The oil pan according to claim 2, wherein the pillar is freestanding and is not in direct contact with the circumferential component.

4. The oil pan according to claim 2, wherein the pillar has a surface and an alignment pin projecting upward from the surface.

5. The oil pan according to claim 2, wherein the pillar has a plurality of fins extending radially outward from a main body thereof.

6. The oil pan according to claim 2, wherein a maximum height to which the pillar reaches is less than a maximum height to which the first finger reaches.

7. The oil pan according to claim 2, wherein the first plug portion includes a lip extending from the interior surface of the first one of the pair of mutually opposing side walls, the lip having an upper surface that is perpendicular to the interior surface of the first side wall.

8. The oil pan according to claim 2, further comprising another pillar adjacent the second plug portion that projects upward from the base wall in the lower extent of the containment portion.

9. The oil pan according to claim 2, wherein the first plug portion is at least partially between a pair of a plurality of inwardly extending ribs of the circumferential component.

10. The oil pan according to claim 2, wherein the second plug portion has a first finger of same or different configurations as the first finger of the first plug portion.

11. The oil pan according to claim 2, wherein the first plug portion has a plurality of fingers, including the first finger, spaced apart from each other in a length direction of the oil pan.

12. The oil pan according to claim 2, wherein the first and second plug portions are located such that an oil tube having a fixed location relative to the engine block aligns adjacent the first plug portion on attachment of the attachment portion to the engine block in the first orientation and aligns adjacent the second plug portion on attachment of the attachment portion to the engine block in the second orientation.

13. An oil receptacle comprising:

a containment portion including:

a circumferential wall defining a circumferential extent of the containment portion and comprising a pair of mutually opposing side walls, and a base wall extending inwardly from a first portion of the circumferential wall and defining a lower extent of the containment portion; and an attachment portion including:

an attachment surface at a second portion of the circumferential wall, a first plug portion on an interior of a first one of the pair of mutually opposing side walls at a first location, a second plug portion on an interior of a second one of the pair of mutually opposing side walls at a second location different from the first location, and a pillar adjacent the first plug portion that projects upward from the base wall in the upper extent of the containment portion, wherein the first plug portion has a first finger that extends radially inwardly, wherein the first and second plug portions are configured to individually receive an oil syphon connector, wherein the attachment portion has a rotational symmetry such that the attachment surface is connectable to an engine block in a first orientation and separately in a second orientation of the oil receptacle, wherein the pillar has a surface and an alignment pin projecting upward from the surface, and wherein the pillar has a plurality of fins extending radially outward from a main body thereof.

14. The oil receptacle according to claim 13, wherein the pillar is freestanding and is not in direct contact with the circumferential wall.

15. The oil receptacle according to claim 13, wherein a maximum height to which the pillar reaches is less than a maximum height to which the first finger reaches.

16. The oil receptacle according to claim 13, wherein the first plug portion includes a lip extending from the interior surface of the first one of the pair of mutually opposing side walls, the lip having an upper surface that is perpendicular to the interior surface of the first side wall.

17. The oil receptacle according to claim 13, further comprising another pillar adjacent the second plug portion that projects upward from the base wall in the lower extent of the containment portion.

18. The oil receptacle according to claim 13, wherein the first plug portion is at least partially between a first pair of a plurality of inwardly extending ribs of the circumferential wall, and wherein the second plug portion is at least partially between a second pair of the plurality of inwardly extending ribs of the circumferential wall.

19. The oil receptacle according to claim 13, wherein the second plug portion has a first finger of same or different configurations as the first finger of the first plug portion, and wherein the first plug portion comprises a second finger and the second plug portion comprises a second finger.

20. The oil receptacle according to claim 13, wherein the first plug portion has a plurality of fingers, including the first finger, spaced apart from each other in a length direction of the oil receptacle.

* * * * *